US009455536B2

(12) United States Patent
Lee et al.

(10) Patent No.: US 9,455,536 B2
(45) Date of Patent: Sep. 27, 2016

(54) ELECTRICAL CONNECTOR CAPABLE OF SUPPRESSING CROSSTALK

(71) Applicant: Advanced-Connectek Inc., New Taipei (TW)

(72) Inventors: Kuo-Ching Lee, New Taipei (TW); Yao-Te Wang, New Taipei (TW); Ya-Ping Liang, Tian-Jin (CN)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/462,617

(22) Filed: Aug. 19, 2014

(65) Prior Publication Data

US 2015/0079844 A1 Mar. 19, 2015

(30) Foreign Application Priority Data

Sep. 13, 2013 (CN) ..... 2013 1 0414928

(51) Int. Cl.
*H01R 13/648* (2006.01)
*H01R 13/6589* (2011.01)
*H01R 13/6587* (2011.01)

(52) U.S. Cl.
CPC ..... *H01R 13/6589* (2013.01); *H01R 13/6587* (2013.01)

(58) Field of Classification Search
CPC ..... H01R 13/6461; H01R 12/724; H01R 13/514; H01R 13/6474; H01R 13/6585
USPC ..... 439/607.34, 95, 607.37, 607.35, 439/607.23, 607.28, 607.07, 108
See application file for complete search history.

(56) References Cited

U.S. PATENT DOCUMENTS 6,409,543 B1 * 6/2002 Astbury, Jr. ..... H01R 13/65807 439/607.07
6,743,057 B2 * 6/2004 Davis ..... H01R 23/688 439/607.05
6,986,682 B1 * 1/2006 Jeon ..... H01R 23/6873 439/607.07
7,074,086 B2 * 7/2006 Cohen ..... H01R 23/688 439/607.08
7,410,393 B1 * 8/2008 Rothermel ..... H01R 29/00 439/49
8,182,289 B2 * 5/2012 Stokoe ..... H01R 23/688 439/607.07
8,870,594 B2 * 10/2014 McClellan ..... H01R 9/22 439/607.05
8,894,442 B2 * 11/2014 McClellan ..... H01R 13/648 439/607.05
9,017,114 B2 * 4/2015 Cohen ..... H01R 12/58 439/607.05
2002/0168898 A1 * 11/2002 Billman ..... H01R 13/514 439/607.07

(Continued)

FOREIGN PATENT DOCUMENTS

NL WO 2012080841 A1 * 6/2012 ..... H01R 12/724

*Primary Examiner* — Tho D Ta
*Assistant Examiner* — Nader Alhawamdeh

(57) ABSTRACT

An electrical connector includes insulating portions arranged side by side, terminal sets, shield sets, and a casing. Each terminal set includes signal terminals and ground terminals. Each signal/ground terminal includes a fixing section disposed in the insulating portion, an assembling section downwardly stretching from the fixing section to protrude from the insulating portion, and a contacting section forwardly stretching from the fixing section to protrude from the insulating portion. Each shield set including shields is disposed on a lateral surface of the insulating portion. Each shield is spacedly arranged and connected to the ground terminal. Each shield includes a body section having at least one bending section, and a protrusion section protruding from the body section. The body section and the protrusion section shield the assembling section and the contacting section of the signal terminal respectively. It can effectively suppress crosstalk between the signal terminals by the shield sets.

10 Claims, 8 Drawing Sheets

(56) References Cited

U.S. PATENT DOCUMENTS

2004/0224559 A1* 11/2004 Nelson ..... H01R 13/514 439/607.05
2007/0004282 A1* 1/2007 Cohen ..... H01R 13/514 439/607.02
2007/0155241 A1* 7/2007 Lappohn ..... H01R 13/514 439/607.07
2008/0214029 A1* 9/2008 Lemke ..... H01R 13/6471 439/108
2009/0035955 A1* 2/2009 McNamara ..... H01R 13/514 439/65
2009/0093158 A1* 4/2009 McAlonis ..... H01R 13/514 439/607.41
2009/0227141 A1* 9/2009 Pan ..... H01R 23/688 439/607.03
2009/0233471 A1* 9/2009 Pan ..... H01R 13/514 439/108
2010/0197149 A1* 8/2010 Davis ..... H01R 12/727 439/59
2010/0240233 A1* 9/2010 Johnescu ..... H01R 13/514 439/108
2011/0117781 A1* 5/2011 Stoner ..... H01R 13/6587 439/607.01
2011/0189892 A1* 8/2011 Mizukami ..... H01R 13/648 439/607.34
2011/0212649 A1* 9/2011 Stokoe ..... H01R 23/688 439/626
2012/0184140 A1* 7/2012 Davis ..... H01R 12/724 439/607.34
2012/0214343 A1* 8/2012 Buck ..... H01R 13/6586 439/607.05
2013/0130550 A1* 5/2013 Wozniak ..... H01R 12/585 439/607.23
2014/0057492 A1* 2/2014 Lange ..... H01R 12/724 439/607.05

* cited by examiner

ELECTRICAL CONNECTOR CAPABLE OF SUPPRESSING CROSSTALK

BACKGROUND OF THE INVENTION

1. Field of the Invention

The present invention relates to an electrical connector and, more particularly, to an electrical connector capable of effectively suppressing crosstalk between signal terminals.

2. Description of the Prior Art

A computer server, such as a blade server, a rack mount server and so on, includes multiple high-speed electrical connectors disposed on its internal circuit boards. The aforementioned electrical connector includes a plurality of terminals arranged intensively to rapidly transmit a large quantity of signals. However, crosstalk frequently happens between signal terminals of the electrical connector, especially in a situation of high-frequency signal transmission, and the crosstalk effect decreases the efficiency of signal transmission or interrupts the signal transmission.

Please refer to FIG. 8, which illustrates an improved electrical connector to suppress crosstalk between its signal terminals. The electrical connector includes a plurality of insulating portions 80 arranged side by side. A terminal set including a plurality of terminals 81 is disposed in the corresponding insulating portion 80, and a shield 82 is disposed on a lateral surface of the corresponding insulating portions 80. Thus, the shields 82 and the insulating portions 80 are arranged in an interlaced manner, and accordingly, the two adjacent terminal sets have the corresponding shield 82 disposed therebetween. Therefore, the electrical connector can suppress crosstalk between the terminal sets. In addition, the electrical connector further includes a casing 83 containing the insulating portions 80, and a cover 84 assembled with the insulating portions 80 to fasten the insulating portions 80. However, the shield 82 is an entirely slice structure with a certain length and width, which easily provides a path with a certain length to transmit electric charges to result in an antenna effect to cause extra signal interference. For example, an oblique path $P_0$ of the shield 82 is the longest path which easily results in the antenna effect.

SUMMARY OF THE INVENTION

The present invention provides an electrical connector capable of effectively suppressing crosstalk between signal terminals and decreasing an antenna effect due to a shield with an entirely slice structure.

According to the invention, an electrical connector capable of suppressing crosstalk includes:

a plurality of insulating portions, with the insulating portions arranged side by side;

a plurality of terminal sets, with each of the terminal sets disposed in the corresponding insulating portion, with each of the terminal sets including a plurality of signal terminals and a plurality of ground terminals, with each of the signal terminals or the ground terminals including a fixing section, an assembling section and a contacting section, with the fixing section disposed in the corresponding insulating portion, with the assembling section downwardly stretching from an end of the fixing section to protrude from the corresponding insulating portion, and with the contacting section forwardly stretching from the other end of the fixing section to protrude from the corresponding insulating portion;

a plurality of shield sets, with each of the shield sets disposed on a lateral surface of the corresponding insulating portion, with each of the shield sets including a plurality of shields, with each of the shields spacedly arranged and connected to the corresponding ground terminal, with each of the shields including a body section and a protrusion section, with the body section having at least one bending section and shielding a lateral surface of the assembling section of the corresponding signal terminal, and with the protrusion section protruding from the body section to be out of the insulating portion and shielding a lateral surface of the contacting section of the corresponding signal terminal; and a casing containing the insulating portions.

According to the invention, the terminal set is disposed in the insulating portion in an insert molding manner.

According to the invention, a plurality of assembling slots is formed on the lateral surface of the insulating portion, and the shield of the shield set is disposed in the corresponding assembling slot.

According to the invention, a plurality of first combining components is formed on the insulating portion, and at least one second combining component is formed on the shield of the shield set to combine with the corresponding first combining component of the insulating portion.

According to the invention, the first combining component is a recess, and the second combining component is a protrusion corresponding to the first combining component.

According to the invention, the first combining component is a protrusion, and the second combining component is a recess corresponding to the first combining component.

According to the invention, a first connecting component is formed on the shield of the shield set, and a second connecting component is formed on the ground terminal to connect with the corresponding first connecting component.

According to the invention, the first connecting component is a buckling unit, and the second connecting component is a buckled aperture corresponding to the buckling unit.

According to the invention, the body section further has a plurality of straight sections, and the bending section has two ends connected to the two corresponding straight sections respectively.

According to the invention, the electrical connector further includes a cover assembled with rear ends of the insulating portions.

According to the invention, a plurality of opening is formed on a front end of the casing, and the contacting section of the signal terminal or the ground terminal is disposed in the corresponding opening.

Each shield set is disposed on the lateral surface of the corresponding insulating portion in which the corresponding terminal set is disposed, so that the terminal sets and the shield sets are arranged in an interlaced manner. Moreover, each shield of the shield set can simultaneously shield the assembling section and the contacting section of the corresponding signal terminal of the terminal set, so that the crosstalk effect between the signal terminals of the adjacent terminal sets can be obviously decreased. In addition, the shields of the shield set are spacedly arranged, and each shield has at least one bending section. Comparing to the conventional single-slice shield shown in FIG. 8, the length of the straight path on the shield is decreased to effectively suppress the antenna effect which results in the extra signal interference, and further to suppress the crosstalk between the signal terminals to increase efficiency and stability of the signal transmission.

These and other objectives of the present invention will no doubt become obvious to those of ordinary skill in the art after reading the following detailed description of the preferred embodiments that are illustrated in the various drawings.

DETAILED DESCRIPTION

Figure 1:
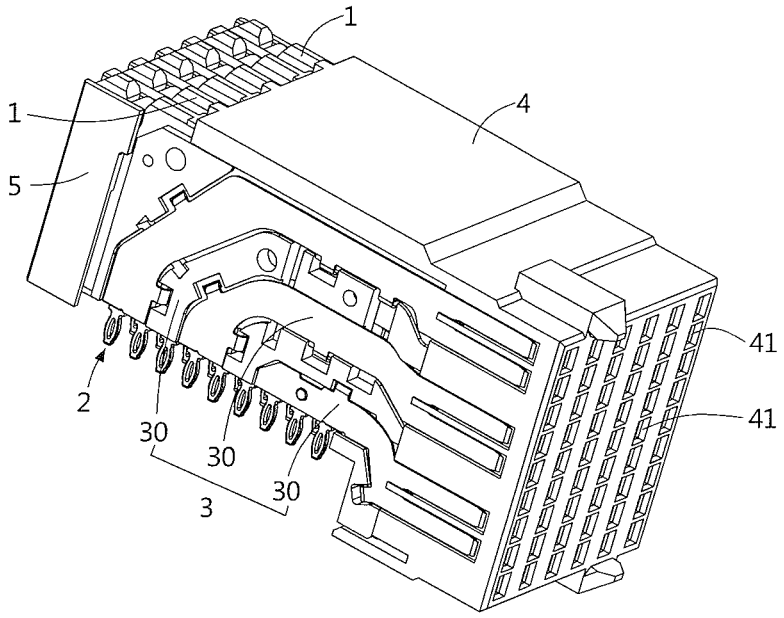
FIG. 1 is an assembled diagram of an electrical connector according to the preferred embodiment of the present invention.

The preferred embodiment of the present invention will now be further described below in detail in conjunction with the accompanying drawings. Wherever possible, the same or similar reference characters are used in the drawings and the description to refer to the same or like parts. For purposes of convenience and clarity only, directional terms, such as upper, lower, front, rear, forwardly, downwardly may be used with respect to the drawings. These and similar directional terms should not be construed to limit the scope of the present invention in any manner.

Figure 2:
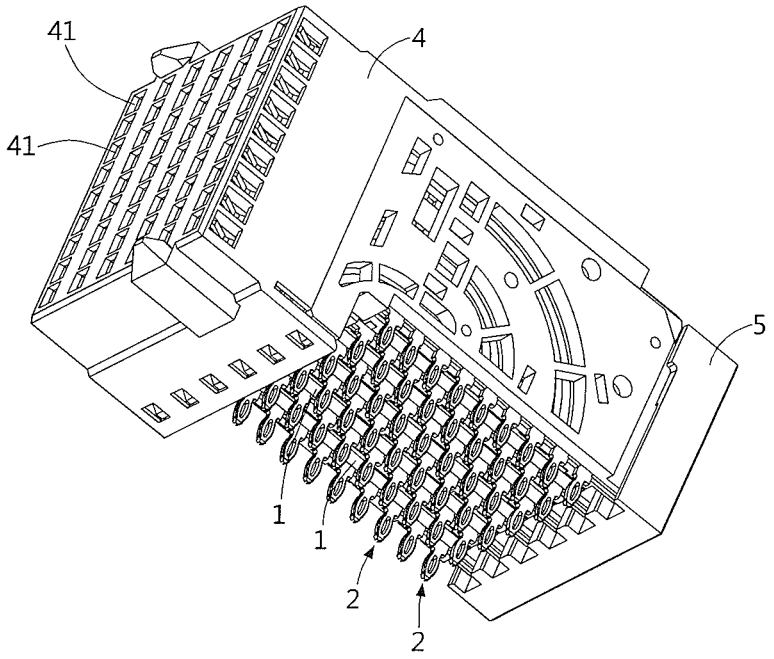
FIG. 2 is another assembled diagram of the electrical connector according to the preferred embodiment of the present invention taken from another point of view.
Figure 3:
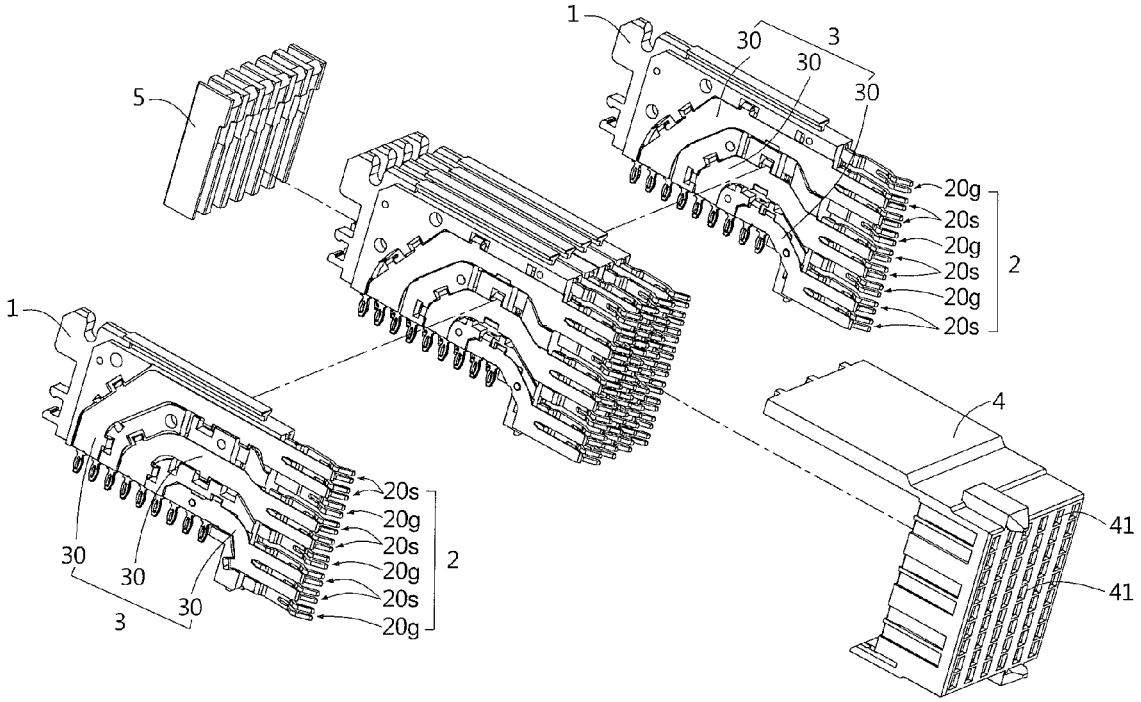
FIG. 3 is a partially exploded diagram of the electrical connector according to the preferred embodiment of the present invention.

Please refer to FIG. 1 and FIG. 2. The present invention provides an electrical connector capable of suppressing crosstalk, which can be disposed on a circuit board (not shown) in a welding manner. The electrical connector includes a plurality of insulating portions 1, a plurality of terminal sets 2, a plurality of shield sets 3, a casing 4 and a cover 5.

Please further refer to FIG. 3 to FIG. 6. Each of the terminal sets 2 is disposed in the corresponding insulating portion 1. In this embodiment, each of the terminal sets 2 is disposed in the corresponding insulating portion 1 in an insert molding manner. Each of the terminal sets 2 includes a plurality of signal terminals 20*s* and a plurality of ground terminals 20*g*. Each of the signal terminals 20*s* or the ground terminals 20*g* includes a fixing section 21, an assembling section 22 and a contacting section 23. The fixing section 21 is disposed in the corresponding insulating portion 1. The assembling section 22 downwardly stretches from an end of the fixing section 21 to protrude from the corresponding insulating portion 1, and can be disposed on the circuit board in a welding manner or a punching manner. The contacting section 23 forwardly stretches from the other end of the fixing section 21 to protrude from the corresponding insulating portion 1. The contacting section 23 can be a fork-shaped unit.

Each of the shield sets 3 is disposed on a lateral surface of the corresponding insulating portion 1. Each of the shield sets 3 includes a plurality of shields 30. In this embodiment, a plurality of assembling slots 10 is formed on the lateral surface of each of the insulating portions 1, and each of the shields 30 of the shield set 3 is disposed in the corresponding assembling slot 10. Each of the shields 30 is spacedly arranged and the adjacent shields 30 do not contact with each other. Each of the shields 30 is connected to the corresponding ground terminal 20*g*. Each of the shields 30 includes a body section 31 and a protrusion section 32. The body section 31 has at least one bending section and shields a lateral surface of the assembling section 22 of the corresponding signal terminal 20*s*. The protrusion section 32 protrudes from the body section 31 to be out of the insulating portion 1 and shields a lateral surface of the contacting section 23 of the corresponding signal terminal 20*s*.

Figure 4:
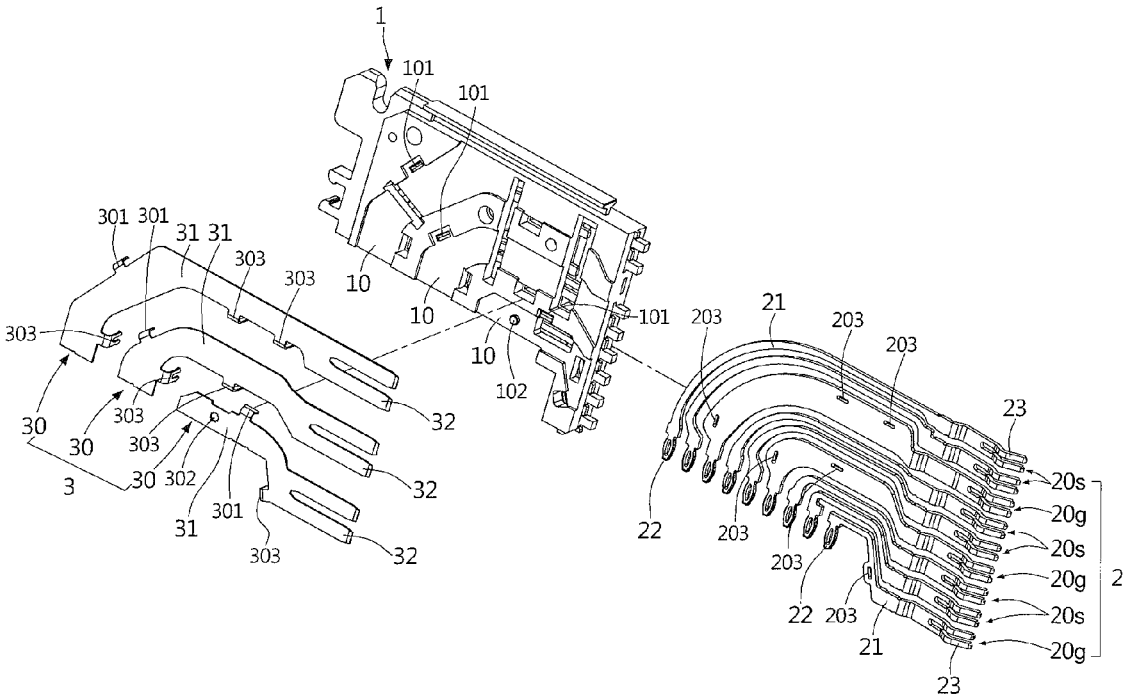
FIG. 4 is an exploded diagram of a set of an insulating portion, a terminal set and a shield set according to the preferred embodiment of the present invention.
Figure 5:
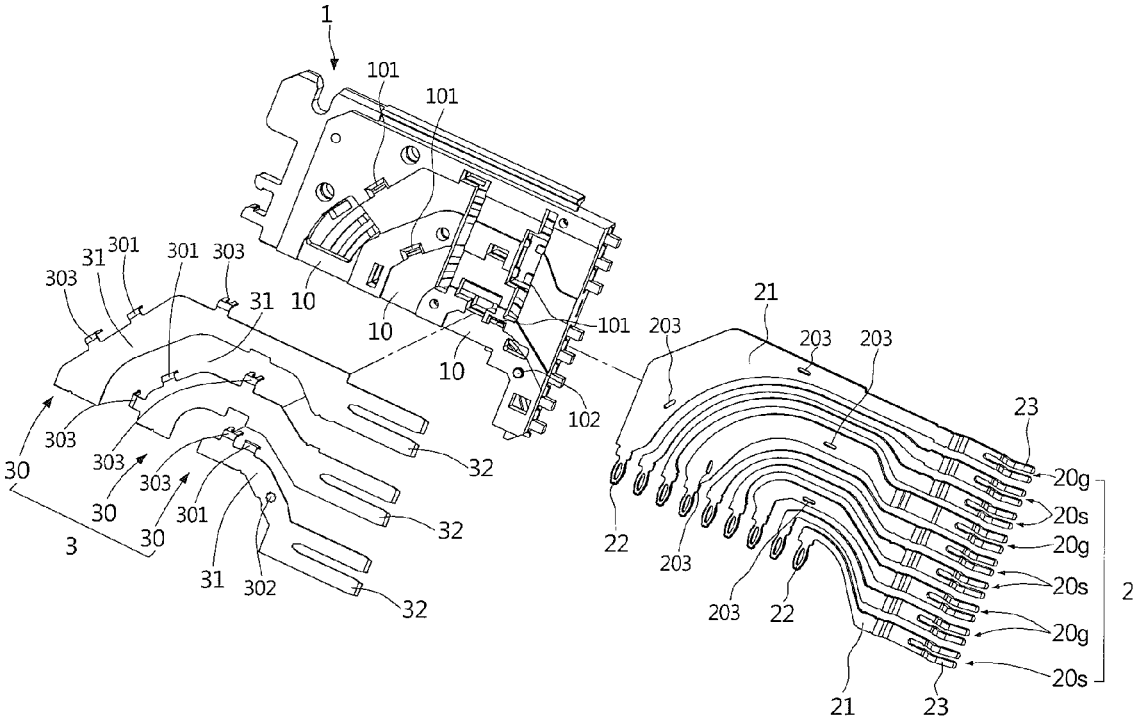
FIG. 5 is an exploded diagram of another set of an insulating portion, a terminal set and a shield set according to the preferred embodiment of the present invention.
Figure 6:
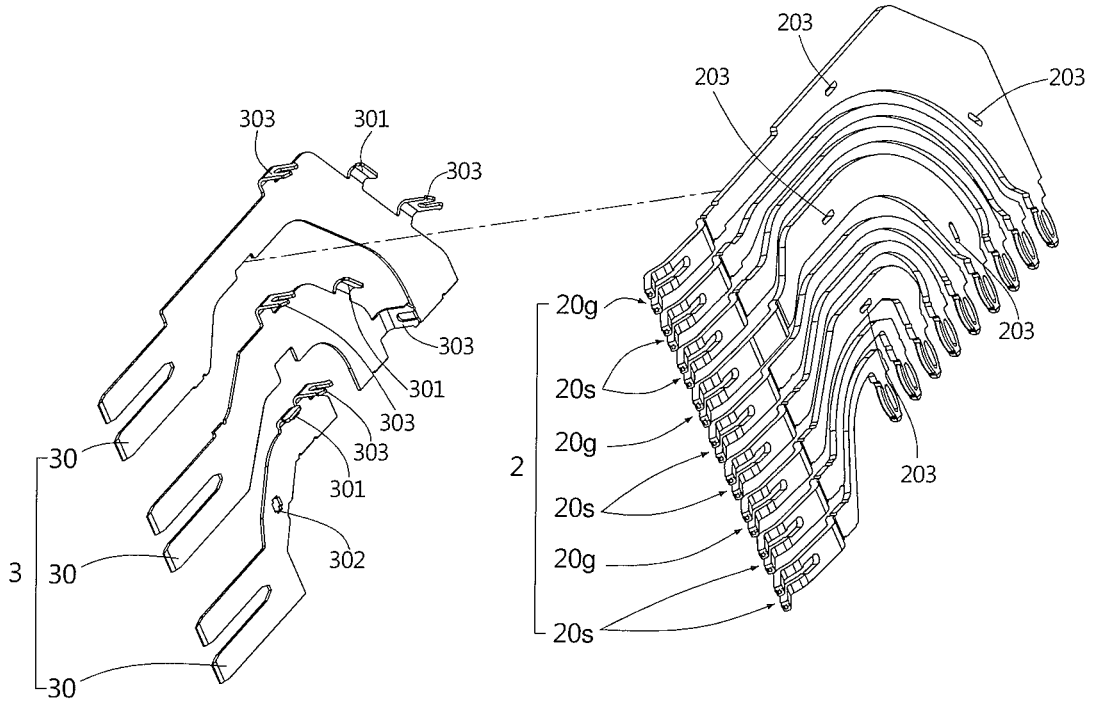
FIG. 6 is an exploded diagram of the terminal set and the shield set according to the preferred embodiment of the present invention.

A plurality of first combining components 101, 102 is formed on each of the insulating portions 1. At least one second combining component is formed on each of the shields 30 of the shield set 3 to combine with the corresponding first combining component of the insulating portion 1. In this embodiment as shown in FIG. 4, one second combining component 301 is formed on the upper or middle shield 30 to combine with the corresponding first combining component 101 formed on the insulating portion 1, and two second combining components 301, 302 are formed on the lower shield 30 to combine with the corresponding first combining components 101, 102 formed on the insulating portion 1. Therefore, each of the shield sets 3 is disposed on the lateral surface of the corresponding insulating portion 1 by assembly of the first combining components 101, 102 and the second combining components 301, 302. In this embodiment, the first combining component 101 is a recess, and the second combining component 301 is a protrusion corresponding to the first combining component 101. Moreover, the first combining component 102 is a protrusion, and the second combining component 302 is a recess corresponding to the first combining component 102.

At least one first connecting component 303 is formed on each of the shields 30 of the shield set 3. A least one second connecting component 203 is formed on the corresponding ground terminal 20*g* to connect with the corresponding first connecting component 303. Thus, each of the shield sets 3 is connected to the corresponding ground terminal 20*g* by assembly of the first connecting component(s) 303 and the second connecting component(s) 203. In this embodiment, the first connecting component 303 is a buckling unit, and the second connecting component 203 is a buckled aperture corresponding to the foresaid buckling unit.

Figure 7:
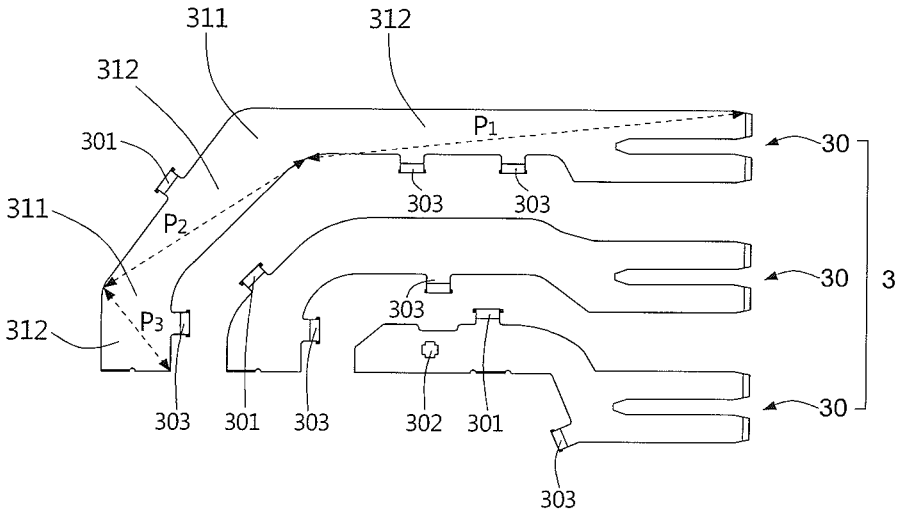
FIG. 7 is a side view of the shield set according to the preferred embodiment of the present invention.

Please further refer to FIG. 7. The body section 31 of each of the shields 30 has at least one bending section 311 and a plurality of straight sections 312. Each bending section 311 has two ends connected to the two corresponding straight sections 312 respectively. According to the antenna effect, an exposed metal block provides an antenna property to gather electric charges and to increase electric potential for generating electric current. The electric current is transmitted through the metal block to easily form high-frequency or low-frequency interference. The shield set 3 is divided into multiple shields 30 spacedly arranged, which effectively decreases the antenna effect of the shield set 3, because each of the shields 30 has a decreased antenna effect. Specifically speaking, the shield 30 is a strip-shaped structure and has a narrow width. The width of the shield 30 is smaller than a width of a conventional single-slice shield whose overall size is substantially equal to assembly of the shields 30, so that the shield 30 can suppress the antenna effect. In addition, the at least one bending section 311 is formed on each shield 30, and the adjacent straight sections 312 cannot connect to each other due to the bending section 311, so that the electric current is not easily transmitted via the shorter paths $P_1$, $P_2$, $P_3$ provided by the straight sections 312, and the antenna effect can be effectively suppressed to prevent an extra signal interference.

Please refer to FIG. 1 to FIG. 3 again. The insulating portions 1 are arranged side by side. The casing 4 contains the insulating portions 1 for assembly of the insulating portions 1. A plurality of openings 41 is formed on a front end of the casing 4, and the contacting section 23 of the signal terminal 20*s* or the ground terminal 20*g* is disposed in the corresponding opening 41. The cover 5 is assembled with rear ends of the insulating portions 1 to ensure that the insulating portions 1 can be accurately arranged side by side and assembled with one another.

The present invention has several advantages. One of the advantages is that each shield set 3 is disposed on the lateral surface of the corresponding insulating portion 1 in which the corresponding terminal set 2 is disposed, so that the terminal sets 2 and the shield sets 3 are disposed in an interlaced manner. Moreover, each shield 30 of the shield set 3 can simultaneously shield the assembling section 22 and the contacting section 23 of the corresponding signal terminal 20*s* of the terminal set 2, so that the crosstalk effect between the signal terminals 20*s* of the adjacent terminal sets 2 can be obviously decreased, thus effectively suppressing the crosstalk between the signal terminals and increasing efficiency and stability of the signal transmission.

Figure 8:
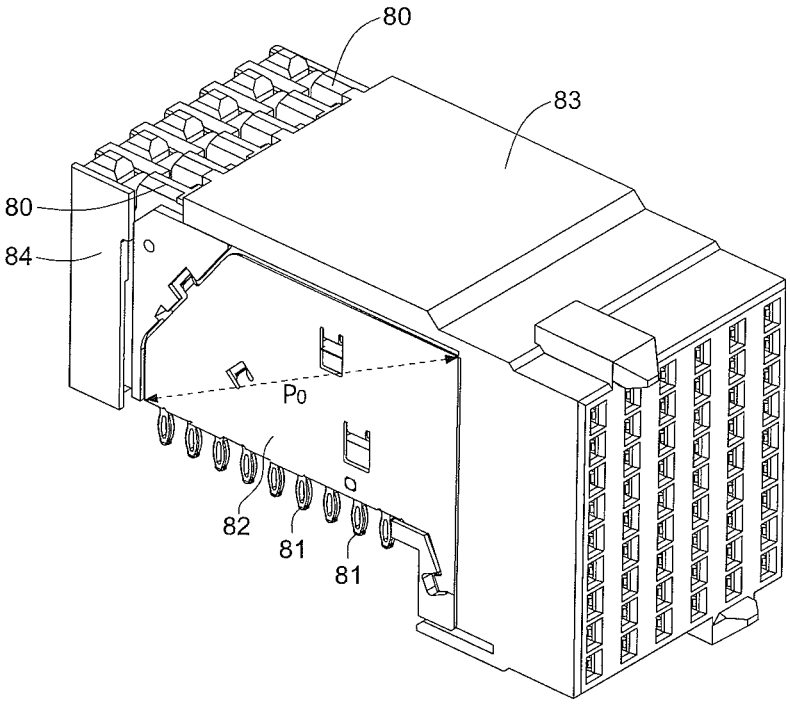
FIG. 8 (Prior Art)
FIG. 8 is a conventional electrical connector with a single-slice shield.

Another advantage is that the strip-shaped shields 30 of the shield set 3 are spacedly arranged, and each shield 30 has at least one bending section 311. Comparing to the conventional single-slice shield 82 shown in FIG. 8, lengths of the straight paths $P_1$, $P_2$, $P_3$ on the shield 30 is decreased to effectively suppress the antenna effect which results in the extra signal interference, and further to suppress the crosstalk between the signal terminals to increase efficiency and stability of the signal transmission.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical connector capable of suppressing crosstalk, comprising:

a plurality of insulating portions, with the plurality of insulating portions arranged side by side;

a plurality of terminal sets, with each of the plurality of terminal sets disposed in a corresponding insulating portion, with each of the plurality of terminal sets comprising a plurality of signal terminals and a plurality of ground terminals, with each of the plurality of signal terminals or the plurality of ground terminals comprising a fixing section, an assembling section and a contacting section, with the fixing section disposed in the corresponding insulating portion, with the assembling section downwardly stretching from an end of the fixing section to protrude from the corresponding insulating portion, and with the contacting section forwardly stretching from another end of the fixing section to protrude from the corresponding insulating portion;

a plurality of shield sets, with each of the plurality of shield sets mounted on a lateral surface of the corresponding insulating portion, with the plurality of terminal sets and the plurality of shield sets disposed in an interlaced manner, with each of the plurality of shield sets comprising a plurality of shields of a strip-shaped structure, with the plurality of shields of each of the shield sets spaced from and not connected to each other after being mounted to the corresponding insulating portion, with each of the plurality of shields simultaneously shielding the assembling section and the contacting section of the corresponding signal terminal of the plurality of terminal sets, with each of the plurality of shields spacedly arranged and connected to the corresponding ground terminal, with each of the plurality of shields comprising a body section and a protrusion section, with the body section having at least one bending section and shielding a lateral surface of the assembling section of the corresponding signal terminal, wherein the body section further has a plurality of straight sections, and wherein the at least one bending section has two ends connected to two corresponding straight sections respectively, with the protrusion section protruding from the body section to be out of the insulating portion and shielding a lateral surface of the contacting section of the corresponding signal terminal; and a casing containing the plurality of insulating portions.

2. The electrical connector of claim 1, wherein each terminal set is disposed in the corresponding insulating portion in an insert molding manner.

3. The electrical connector of claim 2, wherein a plurality of assembling slots is formed on the lateral surface of the corresponding insulating portion, and wherein each shield is disposed in a corresponding assembling slot, with the plurality of shield sets separately formed from the plurality of terminal sets, with the fixing sections of the plurality of terminal sets being intermediate surfaces in the plurality of assembling slots and the plurality of shield sets.

4. The electrical connector of claim 1, wherein a plurality of first combining components is formed on the corresponding insulating portion, and wherein at least one second combining component is formed on each shield to combine with a corresponding first combining component of the corresponding insulating portion.

5. The electrical connector of claim 4, wherein each first combining component is a recess, and wherein each second combining component is a protrusion corresponding to the corresponding first combining component.

6. The electrical connector of claim 4, wherein each first combining component is a protrusion, and wherein each second combining component is a recess corresponding to the corresponding first combining component.

7. The electrical connector of claim 1, wherein a first connecting component is formed on each shield, and a second connecting component is formed on a corresponding ground terminal to connect with the first connecting component.

8. The electrical connector of claim 7, wherein the first connecting component is a buckling unit, and wherein the second connecting component is a buckled aperture corresponding to the buckling unit.

9. The electrical connector of claim 1, further comprising:

a cover assembled with rear ends of the plurality of insulating portions.

10. The electrical connector of claim 9, wherein the protrusion section of each shield comprises a fork portion, a plurality of openings and a plurality of grooves are formed on a front end of the casing, the openings and grooves are not in communication with each other, the fork portions are accommodated in corresponding grooves, and the contacting section of one signal terminal or one ground terminal is disposed in a corresponding opening.

* * * * *